US009218920B2

(12) United States Patent
Cloran et al.

(10) Patent No.: US 9,218,920 B2
(45) Date of Patent: Dec. 22, 2015

(54) FLEXIBLE CABLE ASSEMBLY PROVIDING LOCAL LOCKOUT

(71) Applicant: ROCKWELL AUTOMATION TECHNOLOGIES, INC., Mayfield Heights, OH (US)

(72) Inventors: Shawn D. Cloran, Wauwatosa, WI (US); Edward Byaliy, Mequon, WI (US); Jerry M. Watkins, Franklin, WI (US); Scott B. Lasko, Pewaukee, WI (US); Christopher J Wieloch, Brookfield, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 260 days.

(21) Appl. No.: 14/078,193

(22) Filed: Nov. 12, 2013

(65) Prior Publication Data

US 2015/0131209 A1 May 14, 2015

(51) Int. Cl.

| | |
|---|---|
| ***H01H 3/02*** | (2006.01) |
| ***H01H 9/22*** | (2006.01) |
| ***H01H 9/28*** | (2006.01) |
| ***H01H 71/52*** | (2006.01) |

(52) U.S. Cl.

CPC . *H01H 3/02* (2013.01); *H01H 9/22* (2013.01); *H01H 9/282* (2013.01); *H01H 71/521* (2013.01)

(58) Field of Classification Search

CPC ..... H01H 3/02; H01H 3/20; H01H 3/38; H01H 9/22; Y10T 16/473

See application file for complete search history.

(56) References Cited

U.S. PATENT DOCUMENTS

| | | | | |
|---|---|---|---|---|
| 3,939,725 | A * | 2/1976 | Fisher | G05G 1/00 200/331 |
| 4,626,638 | A * | 12/1986 | Samples | H01H 3/36 200/331 |
| 5,193,666 | A * | 3/1993 | Markowski et al. | H01H 3/04 16/429 |
| 5,428,196 | A * | 6/1995 | Beatty, Jr. | H01H 3/36 200/329 |
| 5,663,862 | A | 9/1997 | Hopping-Mills | |
| 5,973,279 | A | 10/1999 | Turner et al. | |
| 6,504,460 | B2 | 1/2003 | DeGrazia et al. | |
| 6,590,756 | B2 * | 7/2003 | Meiners | H02B 1/38 200/331 |
| 6,642,463 | B1 | 11/2003 | Turner | |
| 6,710,697 | B1 | 3/2004 | Houck, III | |
| 6,989,499 | B2 * | 1/2006 | Bortolloni | H01H 9/28 200/329 |
| 8,420,963 | B2 * | 4/2013 | Bhathija | H01H 9/286 200/50.12 |
| 2002/0149451 | A1 | 10/2002 | Bogdon | |
| 2014/0090963 | A1 * | 4/2014 | Sudhakar | H01H 71/0221 200/50.22 |

FOREIGN PATENT DOCUMENTS

WO 2012117270 A1 9/2012

OTHER PUBLICATIONS

Extended European Search Report dated Apr. 5, 2015. Application No. 14192404.3—(7) pages.

* cited by examiner

*Primary Examiner* — Gregory Thompson

(74) *Attorney, Agent, or Firm* — Boyle Fredrickson, S.C.

(57) ABSTRACT

A remote switching system for electrical switches in a cabinet provides an actuator frame and slider that may be assembled to the electrical switch to engage the switch actuator for remote control. The actuator frame includes an opening allowing insertion of a lock shank through the opening to block motion of the slider from an "off" state to an "on" state thereby allowing the actuator frame to also serve as a local lockout.

17 Claims, 6 Drawing Sheets

FIG. 11
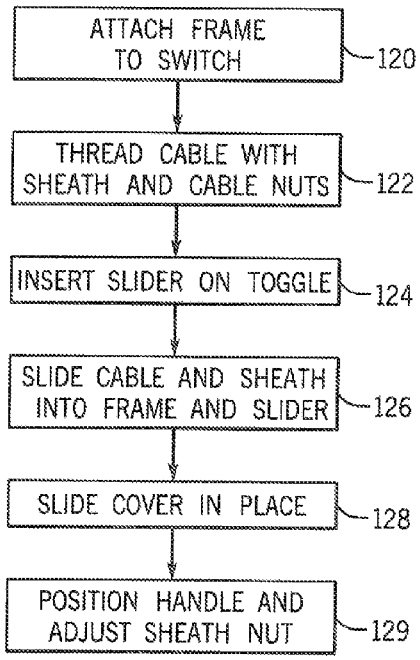
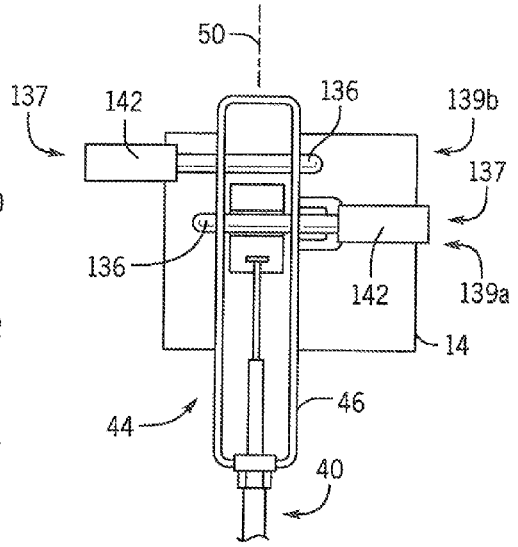
FIG. 12
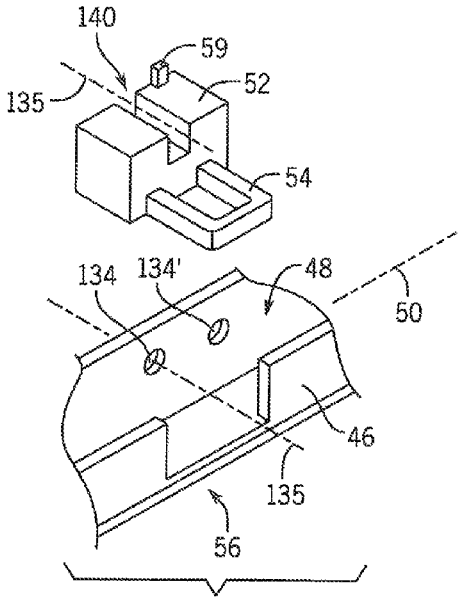
FIG. 13
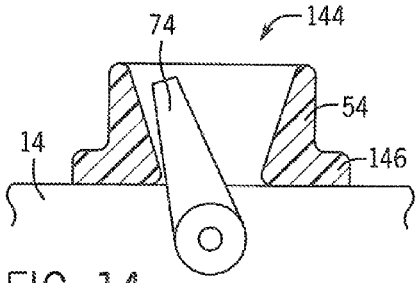
FIG. 14

FLEXIBLE CABLE ASSEMBLY PROVIDING LOCAL LOCKOUT

BACKGROUND OF THE INVENTION

The present invention relates to high-power electrical switches, and in particular to a flexible cable assembly for remotely actuating electrical switches such as circuit breakers.

High-power electrical circuitry is normally placed inside a metal cabinet to protect the electrical circuitry from the external environment and to shield users from potential hazards associated with the operation of the circuitry.

Often the cabinet provides a handle that serves both to lock a cabinet door and to disconnect electrical power from the interior circuitry before the door is opened. The handle may communicate through a flexible cable assembly with a switch inside the cabinet, for example, a circuit breaker, so that when the handle is moved to allow opening of the cabinet door, the circuit breaker is also opened, removing electrical power from the interior circuitry. This feature is normally subject to the mechanical override in the event that the cabinet must be operated with the door open and the circuitry live.

A flexible cable assembly provides a substantially incompressible sheath through which a flexible cable may slide. Opposite ends of the sheath are fixed, respectively, to a stationary structure of the handle and an actuator frame attached to the circuit breaker housing. One end of the flexible cable is then attached to a movable portion of the handle to communicate this motion through the flexible cable to a slider held within the actuator frame. The slider may provide a collar capturing a toggle operator of the circuit breaker to move the circuit breaker toggle between an "on" and "of" position with movement of the flexible cable by the handle.

When it is necessary to work on equipment controlled by the circuitry within the cabinet, it is known to move the handle to the "off" position thereby disconnecting electrical power to the interior circuitry as described above. The handle normally provides a locking feature allowing insertion of a padlock or the like through portions of the handle preventing the handle from being moved from the "off" position to the "on" position. While the electrical power is thereby removed from the interior circuitry, this state of the handle allows opening of the cabinet door such as may allow access to the interior circuitry. Such access could allow inadvertent reactivation of the circuit breaker, for example, by damage or disconnection of the flexible cable, risking unexpected machine activation.

SUMMARY OF THE INVENTION

The present invention provides a remote actuator system that allows a lock such as a padlock to be placed directly on the actuator frame on the electrical switch to prevent switching of the associated electrical switch. By employing the collar and slider system of the actuator a direct locking of the electrical switch may be provided even when features for locking are not included in the lock itself.

In one embodiment, the invention provides a remote switching assembly for use with an electrical switch having a switch operator movable along an actuation axis which includes an actuator flame presenting a longitudinal channel extending along a longitudinal axis and attachment elements for attaching the actuator frame to a housing of an electrical switch adjacent to the switch operator so that the longitudinal axis is substantially parallel to the actuation axis. A slider fitting within the longitudinal channel of the actuator frame may slide along the longitudinal axis and may provide a collar receiving the switch operator when the actuator frame is fixed to the housing of the electrical switch, so that movement of the slider along the actuation axis may switch the switch operator between "on" and "off" states. A flexible cable assembly provides a sheath surrounding a flexible cable, the first end of the sheath attached to the actuator frame and a first end of the flexible cable attached to the slider. The actuator frame provides at least one opening through the channel for receiving a lock shank to extend into the channel to block motion of the slider along the actuation axis to switch the switch operator from the "off" state to the "on" state.

It is thus a feature of at least one embodiment of the invention to provide an ability to locally lock an electrical switch for extra assurance that the switch remains in an "off" state.

The actuator frame may provide two opposed openings on opposite walls of the channel so that the lock shank may extend fully across the channel.

It is thus a feature of at least one embodiment of the invention to fully block the channel to prevent ready defeat of the lock.

One opening may also provides passage of the collar of the slider out of the channel for motion of the slider along the actuation axis between the "off" state and the "on" state.

It is thus a feature of at least one embodiment of the invention to provide a lockout system that works with the large opening for the slider collar allowing simplified installation of the lock in awkward working environments.

The slider may include a third opening aligning with the two opposed openings through the channel when the slider is in the "off" state to receive the lock shank.

It is thus a feature of at least one embodiment of the invention to positively lock the slider within the channel.

The third opening may be an upwardly opening slot extending perpendicularly to the actuation axis.

It is thus a feature of at least one embodiment of the invention to allow simple injection molding of the slider.

The attachment elements may be flange portions of the actuator frame having holes for receiving machine screws to attach the actuator frame to the electrical switch.

It is thus a feature of at least one embodiment of the invention to prevent rapid defeat of the lockout by requiring removal of multiple machine screws yet allowing removal when necessary.

The remote switching assembly may include a cover fitting over the channel in the channel element of the actuator frame and the openings may be located to permit installation of the cover without interference from the lock shank.

It is thus a feature of at least one embodiment of the invention to permit the lock to be used without disassembly of the cover.

The cover may be attached to the actuator frame by interengaging hook elements engaged by sliding of the cover and retained by a snap detent.

It is thus a feature of at least one embodiment of the invention to provide security against tampering with the slide when the cover is readily removable.

The actuator frame and the slider may be injection molded thermoplastic.

It is thus a feature of at least one embodiment of the invention to increase the resistance of the actuator assembly to tampering when constructed of thermoplastic material.

The sheath and the flexible cable of the flexible cable assembly may be connected to the actuator frame and the slide by means of keyway slots slidably engaging flange features on the sheath and flexible cable.

It is thus a feature of at least one embodiment of the invention to provide security against defeat of the actuator by removal of the cable by positively locking the slider.

The remote switching assembly may further include a handle mechanism that is mountable to a cabinet surface having a handle frame and a handle movable with respect to the handle frame between a first position and a second position and wherein a second end of the sheath is attached the handle frame and a second end of the flexible cable is attached to the handle so that movement of the handle between the first position and second position move the slider in a range sufficient to switch the switch operator between the "on" and "off" states.

It is thus a feature of at least one embodiment of the invention to provide robust lockout against remote actuation of the electrical switch.

The handle mechanism further includes an opening for receiving a lock shank for preventing movement of the handle from an off position in which the switch operator is in the "off" state to an on position.

It is thus a feature of at least one embodiment of the invention to provide a robust lockout against actuation of the electrical switch by damage or removal of the flexible cable.

The above aspects of the invention are not intended to define the scope of the invention for which purpose claims are provided. In the following description, reference is made to the accompanying drawings, which form a part hereof and in which there is shown by way of illustration, and not limitation, a preferred embodiment of the invention. Such embodiment does not define the scope of the invention and reference must be made therefore to the claims for this purpose.

BRIEF DESCRIPTION OF THE DRAWINGS

Reference is hereby made to the following figures in which like reference numerals correspond to like elements throughout, and in which:

FIG. 11 is a flowchart of the manufacturing steps for assembling the switching system in one embodiment of the present invention;

FIG. 12 is a schematic representation of the actuator assembly and electrical switch showing alternative locations for a padlock for locking the slider and electrical switch in the off position;

FIG. 13 is an exploded perspective view of the actuator frame and slider showing multiple positions of locking holes and an optional slot in the slider; and FIG. 14 is a cross-sectional view through the collar of the slider showing its funnel-like opening.

DETAILED DESCRIPTION OF THE INVENTION

Figure 1:
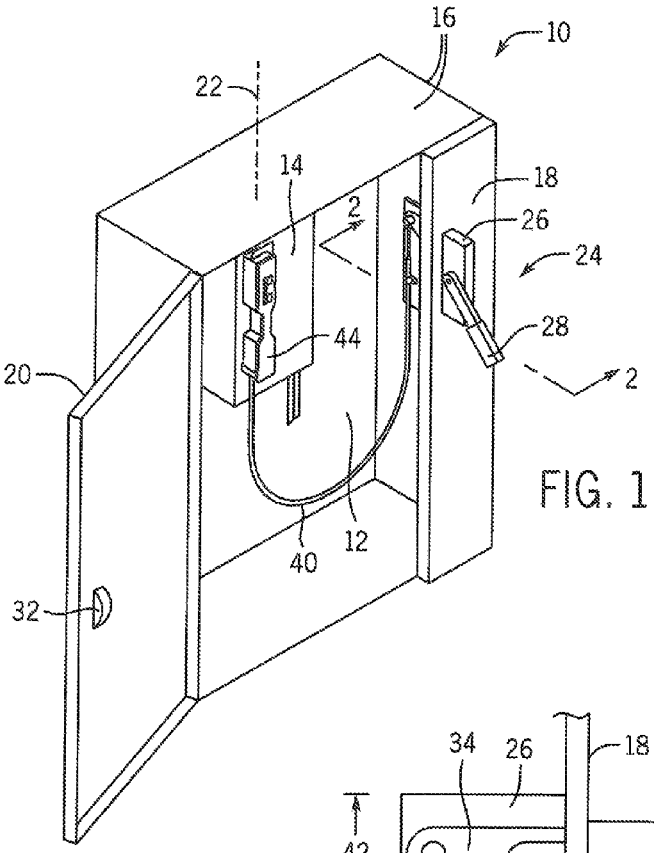
FIG. 1 is a simplified perspective view of an open electrical cabinet showing an exterior accessible handle assembly communicating by a flexible cable with an actuator assembly on an electrical switch.

Referring now to FIG. 1, an electronics cabinet 10, for example, constructed of sheet steel, may provide a generally rectangular rear wall 12 to which electrical equipment may be attached including an electrical switch 14 such as a circuit breaker, disconnect switch, or the like. Top and side walls 16 of the electronic cabinet 10 extend forward from the periphery of the rear wall 12 and may be covered by a combination of the front panel 18 and door 20 to define a cabinet interior. The door 20 may hinge between open and closed position, for example, along a hinge axis 22 at a front vertical edge of left side wall 16.

The front panel 18 may be fixed to one edge of the cabinet 10 against a left side wall 16 and spanning an upper and lower side wall 16 and may support a handle assembly 24. The handle assembly 24 may include a frame 26 supporting a pivoting handle 28 which may swing between an upper "on" position and a lower "off" position (the latter shown in FIG. 1) as manipulated by a user.

Figure 2:
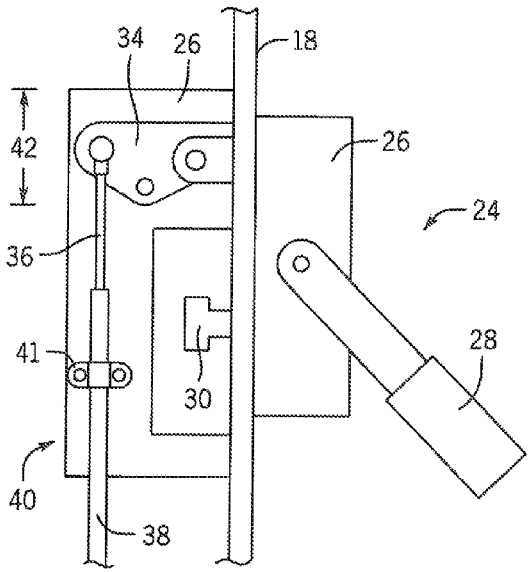
FIG. 2 is a side elevational view of the handle assembly showing attachment of the flexible cable to that assembly.

Referring also to FIG. 2, as is generally understood in the art, in the lower "off" position, a latch lever 30 interacting with a latch strike 32 on the door 20 may allow opening of the door 20 from a closed position. Conversely, when the handle 28 is in the upper "on" position, the latch lever 30 may interact with the latch strike 32 to hold the door closed in a locked position.

Generally, the movable handle 28 controls an actuation linkage 34 attached to a portion of the handle frame 26 inside the cabinet 10. This actuation linkage 34 in turn may be attached to a flexible cable 36 fitting within a tubular cable sheath 38 together forming a flexible cable assembly 40. The end of the sheath at the handle assembly 24 may be fixed by a clamp 41 to the handle frame 26 so that movement of the actuation linkage 34 by the handle 28 slides the flexible cable 36 within the sheath 38.

As is generally understood in the art, the flexible cable 36 and tubular cable sheath 38 may be relatively freely flexed across their axes of extension but are substantially resistant to changes in dimension in tension or compression along their axes of extension to efficiently transmit the relative motion between the flexible cable 36 and the sheath 38 to a remote location. Generally, motion of the handle 28 through its entire range will provide for a relative movement between the flexible cable 36 and the cable sheath 38 of a predefined distance 42 as will be discussed further below. The actuation linkage 34 controls the relationship between the movement of the handle 28 and the desired predefined distance 42 of the flexible cable 36.

Referring again to FIG. 1, flexible cable assembly 40 may pass through the interior of the cabinet 10 to an actuator assembly 44 attached to a front face of the electrical switch 14.

Figure 3:
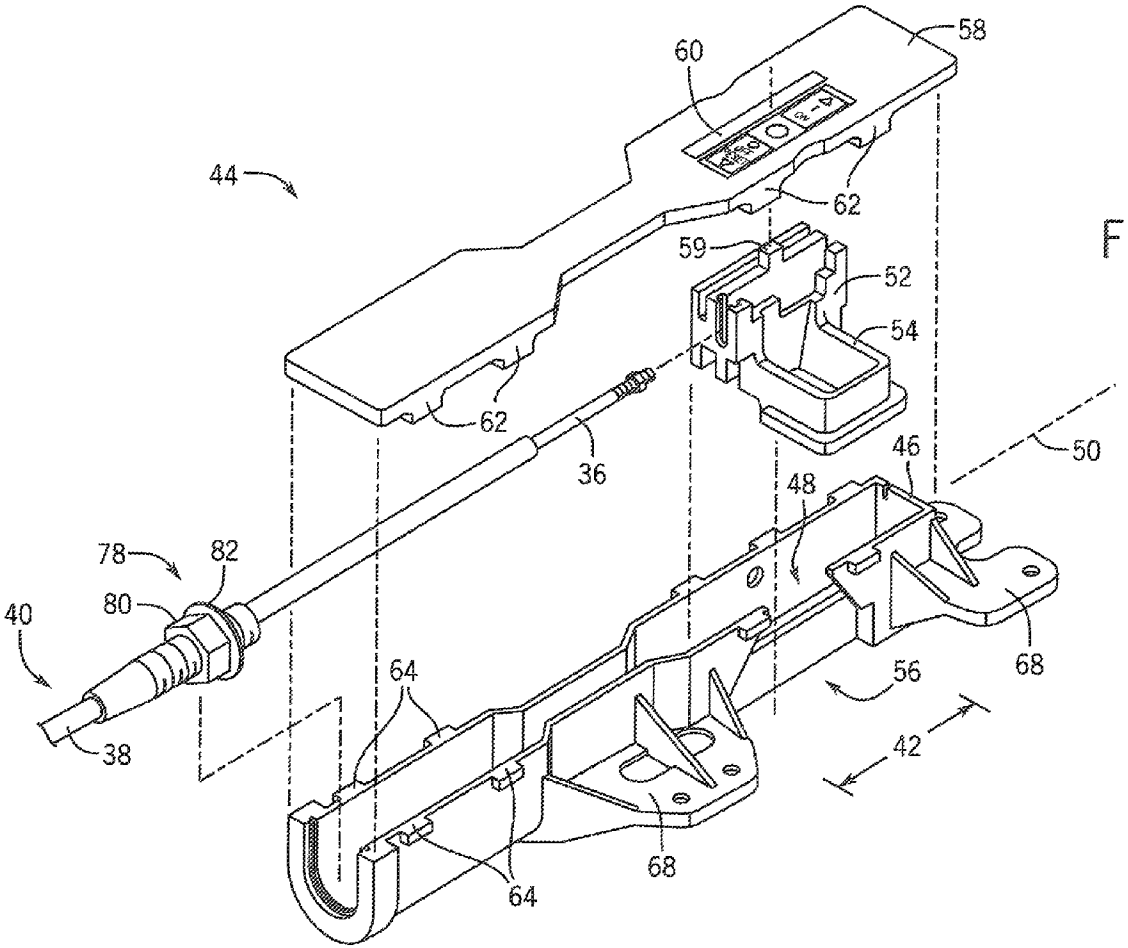
FIG. 3 is an exploded perspective view of the actuator assembly showing the components of an actuator frame, a slider, and a cover as may together secure an end of the flexible cable.

Referring now to FIG. 3, the actuator assembly 44 generally provides an actuator frame 46 presenting a generally upwardly open channel 48 extending along an actuation axis 50. A slider 52 may fit in an upper length of the channel 48 to slide therealong and may provide a sidewardly extending collar 54 projecting through an opening 56 in the side wall of the channel of the actuator frame 46. The size of the opening 56 is such as to permit the slider 52 to slide at least by the predefined distance 42 described above.

The cable assembly 40 may attach to a lower end of the actuator frame 46 (as will be discussed below) so that the flexible cable 36 extending through the sheath 38 may pass into the channel 48 along the actuation axis 50 to attach to the slider 52. As so assembled, movement of the flexible cable 36 will move the slider 52 along the actuation axis 50 within the actuator frame 46.

When the slider 52 is within the channel 48 and the cable assembly 40 attached to the actuator frame 46, an actuator frame cover 58 may be installed to cover the upper opening of the channel 48 and a portion of the cable assembly 40 within that channel 48. With the actuator frame cover 58 in place, the collar 54 remains uncovered, projecting from the side of the actuator frame 46.

A fiducial feature 59 of the slider 52 may project upward through a slot 60 in the actuator frame cover 58 so that the relative position of the slider 52 within the actuator frame 46 may be visually determined through the actuator frame cover 58. Generally, the actuator frame cover 58 may be attached to the actuator frame 46 by sliding engagement between a set of downwardly extending hooks 62 on the actuator frame cover 58 and laterally outwardly extending hooks 64 at an upper edge of the channel 48 of the actuator frame 46, as will be discussed in more detail below.

Figure 4:
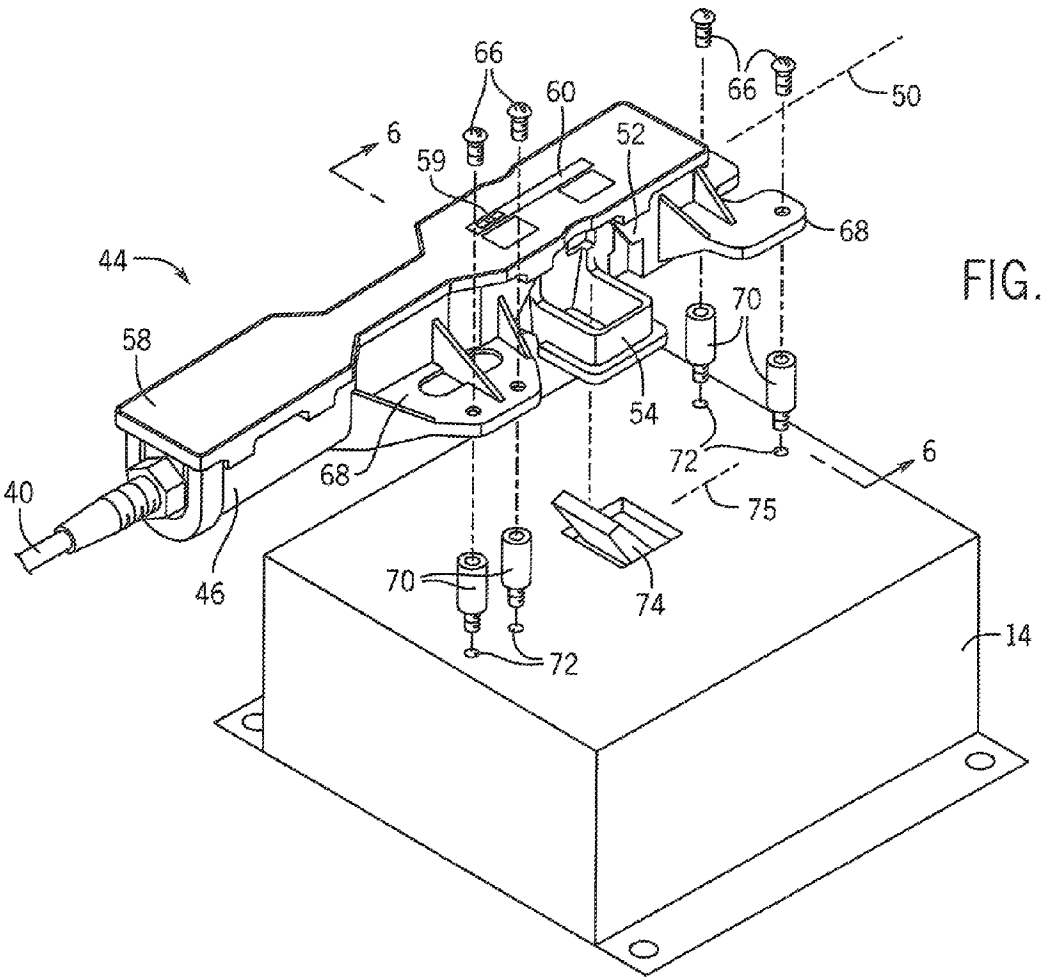
FIG. 4 is an exploded view of the assembled actuator assembly positioned with respect to the electrical switch for attachment thereto.

Referring also to FIG. 4, the actuator frame 46 may be attached to a front face of the electrical switch 14 by means of machine screws 66 passing through holes in horizontally extending flanges 68 in the actuator frame 46 and then through standoffs 70 to threaded bores 72 in the front face of the switch 14. When the actuator frame 46 is so attached, the collar 54 of the slider 52 surrounds an upwardly extending toggle operator 74 of the electrical switch 14 that may swing or toggle along a toggle operation axis 75. The toggle operation axis 75 is aligned with the actuation axis 50 of the actuator frame 46 when the actuator frame 46 is attached to the housing of the electrical switch 14.

This inter-engagement of the toggle operator 74 is such as to allow movement of the slider 52 and collar 54 to fully actuate electrical switch 14, moving the toggle operator 74 between an "on" position in which electrical current is conducted through the electrical switch 14 and "off" position in which electrical current is interrupted, when the slider 52 moves by the predefined distance 42.

Each of the slider 52, actuator frame cover 58, and actuator frame 46 may be constructed of injection molded thermoplastic having a high electrical dielectric to resist electrical conduction through these components to the flexible cable 36 should electrical power be applied to any of these components.

Figure 5:
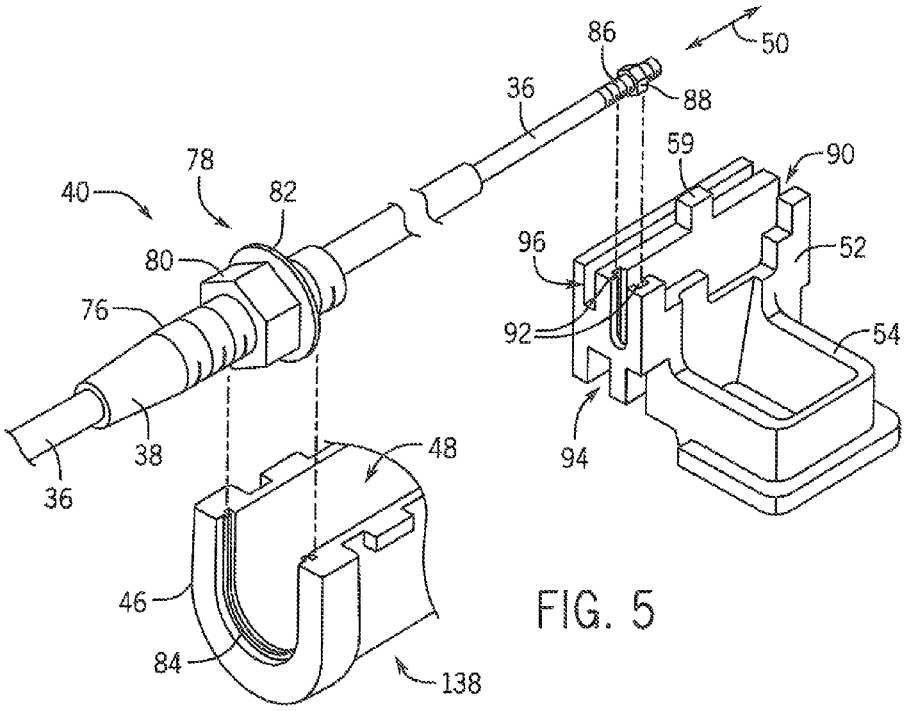
FIG. 5 is a fragmentary perspective view of an end of the actuator assembly and the slider showing interfacing of a threaded fastener on the flexible cable sheath to the actuator assembly and a lock nut on the flexible cable to the slider.

Referring now to FIG. 5, the end of the cable assembly 40 which is attached to the actuator frame 46 may provide a threaded ferrule 76, for example, crimped to an outer surface of the sheath 38 to present threads on its outer diameter. A threaded fastener 78 comprising, for example, a hex nut 80 having a radially projecting circular flange 82 attached at one face of the hex nut 80 may be received on the threaded ferrule 76. The hex nut 80 may, in one example, provide for opposed flats receivable by a standard open end wrench and separated by three-quarters of an inch or approximately 19 mm to be readily adjusted with common wrench sizes.

The radially projecting circular flange 82 may be substantially cylindrical like a washer and of greater diameter than the diameter of a circle circumscribing the flats of the hex nut 80. For example, the circular flange 82 may have a diameter of 1 inch and an axial thickness of approximately 9/16 of an inch. The lower end of the actuator frame 46 may provide a U-shaped groove 84 of equal diameter to the circular flange 82 that may receive the circular flange 82 while allowing the hex nut 80 to extend outward from the actuator frame 46 to be readily accessible. The U-shaped groove 84 is sized to permit free rotation of the circular flange 82 therein but to substantially resist translation of the circular flange along the actuation axis 50.

It will be appreciated that rotation of the threaded fastener 78 will move the threaded fastener along the threaded ferrule 76 adjusting the relative point of attachment of the sheath 38 to the actuator frame 46 as will be discussed further below. When the actuator frame cover 58 of FIG. 3 is on the actuator frame 46, the circular flange 82 is captured between the groove 84 and underside of the actuator frame cover 58 blocking movement of the circular flange 82 against substantial upward movement and removal.

Referring still to FIG. 5, the end of the flexible cable 36 extending from the sheath 38 within the channel 48 may be threaded with threads 86 to receive a lock nut 88 designed to stay substantially fixed on the threads 86 once the lock nut 88 and threads 86 are engaged. A wide variety of lock nuts of this type are known including those with jamming threads or deforming features that engage the threads 86. The lock nut 88 may be received within a channel 90 of the slider 52 opening upward and having a laterally extending keyway with opposed slots 92 that capture the axially opposed faces of the lock nut 88 against movement along actuation axis 50 with respect to the slider 52. Thus, movement of the flexible cable 36 within the sheath 38 will move the slider 52.

Figure 6:
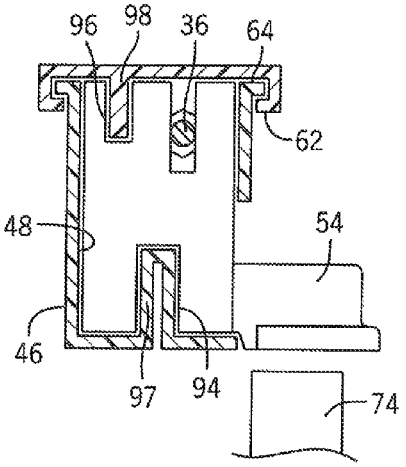
FIG. 6 is a cross-sectional view along line to 6-6 of FIG. 4 showing opposed channels in the slider and rails on the actuator frame and actuator cover for guiding the slider.

Referring now also to FIG. 6, the slider 52 may have a lower axial channel 94 and upper axial channel 96 on opposed lowering upper faces of the slider 52 extending generally parallel to the actuation axis 50. The lower axial channel 94 and upper axial channel 96 may each engage a corresponding axial guide rail 97 with axial guide rail 97 extending upward from a bottom of the channel 48 of the actuator frame 46 and guide rail 98 extending downward from the underside of the actuator frame cover 58. These two rails 97 and 98 provide a low friction interface of plastic on plastic allowing smooth sliding action of the slider 52 within the channel 48 of the actuator frame 46 and resist any rocking or torquing action that might jam or earn the two surfaces.

Figure 7:
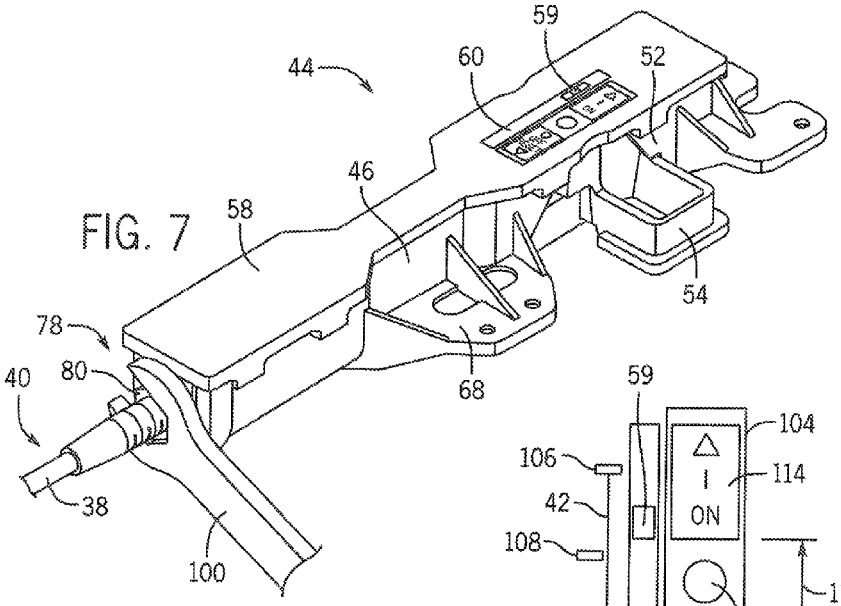
FIG. 7 is a perspective view of the assembled actuator assembly showing location of a wrench during the tuning process which may be accomplished with a simple adjustment of the threaded fastener alone.
Figure 8:
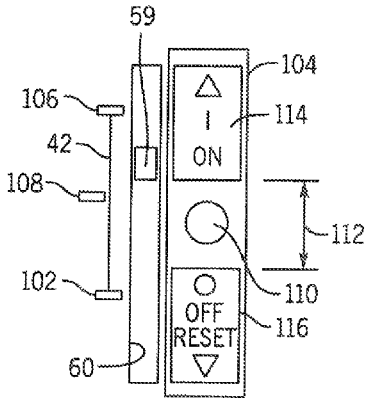
FIG. 8 is a top plan view of a label on the cover for identifying the position of the slider within the actuator assembly visible through a slot next to the label.

Referring now to FIGS. 7 and 8, adjustment of the threaded fastener 78 may be conducted by placing a standard open end wrench 100 on the hex nut 80 which protrudes from out of the assembled actuator frame 46 and actuator frame cover 58. This process is normally conducted by the manufacturer but can also be performed by the end-user. In order to make this adjustment, the handle 28 (shown in FIG. 1, but typically a jig when this is done in a manufacturing environment) may be moved to the "off" position and an off extreme point 102 may be established with respect to a visual scale 104 printed on an upper surface of the actuator frame cover 58 along slot 60 through which the fiducial feature 59 may be viewed. The off extreme point 102 may be a center point of the fiducial feature 59 when the handle 28 is in the "off" position.

The handle 28 may then be moved to the "on" position and the on extreme point 106 established with respect to the scale 104. The predefined distance 42 will be the distance between the on extreme point 106 and the off extreme point 102. The threaded fastener 78 may then be adjusted to move a center point 108 between the off extreme point 102 and on extreme point 106 to be approximately centered at a center point 110 of the visual scale 104. The tuned assembly is then sent to the user who normally need not adjust the threaded fastener 78 on-site.

The visual scale 104 includes a dead zone 112 about the center point 110 indicating the region where the position of the toggle operator 74 shown in FIG. 4 cannot reliably be known to be in either the "on" or "off" position because of normal manufacturing tolerances in the operation of the electrical switch 14, play between the collar 54 and the toggle operator 74, play between the axial location of the actuator frame cover 58 and the actuator frame 46 and other tolerance factors. Above the dead zone 112 will be an on zone 114 indicating a position of the fiducial feature 59 when the electrical switch 14 is reliably in the on state. This on zone 114 may be marked with a color red, indicating the hazard of active electrical components within the cabinet 10, and the symbols for the "on" state including the international symbol of an I and the word "on". Below the dead zone 112 will be an off zone 116 which may be labeled in a green color and include the international symbol for off of O, the word "off" and the word "reset".

Figure 9:
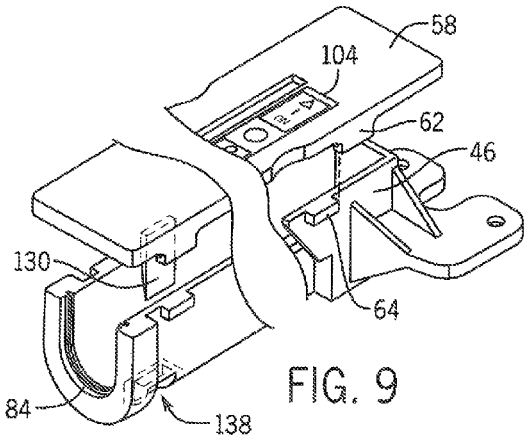
FIG. 9 is a fragmentary exploded view of the actuator frame and the actuator cover showing interlocking hooks that allow assembly of the two with a simple sliding motion.
Figure 10:
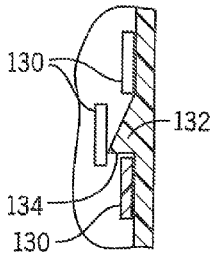
FIG. 10 is a schematic top plan diagram of the locking tab showing its operation.

Referring now to FIGS. 9 and 10, the configuration of the components described above greatly simplifies assembly of the actuator assembly 44, flexible cable assembly 40, and handle assembly 24 as well as assembly within a system as shown in FIG. 1 including electrical switch 14 and cabinet 10.

In that assembly process conducted at the manufacturer, the actuator frame 46 is first attached to the switch 14 as discussed above with respect to FIG. 4 and as indicated by process block 120. At this time, both the actuator frame cover 58 and the cable assembly 40 may be removed making this attachment process relatively simple by eliminating the weight and/or torque imparted by these additional components.

As indicated by process block 122, the threaded fastener 78 may then be assembled onto the threaded ferrule 76 as shown in FIG. 5 and the lock nut 88 may be attached to the threads 86 on the flexible cable 36 as shown in FIG. 5.

At process block 124, the slider 52 may be inserted into the channel 48 so that the collar 54 fits around the toggle operator 74 as shown in FIG. 4. Per process block 126, the threaded fastener 78 may then be inserted into the groove 84 of the actuator frame 46 and, as indicated by process block 128, the actuator frame cover 58 installed on the actuator frame 46 and the nut 88 inserted into the slots 92 of the slider 52 it will be understood that in some cases these steps may be duplicated by the end-user in the event of repair or tuning.

Referring now to FIGS. 6 and 9, the installation of the actuator frame cover 58 on the actuator frame 46 may be accomplished by simply placing the actuator frame cover 58 down against the upper edge of the actuator assembly 44 so that the hooks 62 may pass past the hook 64 discussed above with respect to FIG. 3. The actuator frame cover 58 may then be moved axially to engage hooks 62 and 64 which serve to prevent lifting off of the actuator frame cover 58.

The actuator frame cover 58 may include a downwardly extending lock tab 130 that passes over a locking ramp 132 on an inner vertical wall of the actuator frame 46 near groove 84. As shown in FIG. 10, axial sliding of the actuator frame cover 58 moves the lock tab 130 over the interior ramp 132 causing it to deflect inward and then spring outward against the perpendicular face 134 of the ramp 132 preventing retraction of the actuator frame cover 58 under normal use. Retraction of the actuator frame cover 58 can be provided by the insertion of a screwdriver blade through an aperture 138 in the bottom of the channel 48 of the actuator frame 46 to pry the lock tab 130 over ramp 132 allowing the actuator frame cover 58 to be released.

Referring again to FIG. 10, in a final step 129, the handle 28 may be positioned successively in its "on" and "off" positions and the threaded fastener 78 adjusted as described above with respect to FIG. 8.

Referring now to FIGS. 1, 11, and 12, in one embodiment, a lock aperture 134 may be provided in one vertical wall of the actuator frame 46 providing a transverse path 135 perpendicular to actuation axis 50 through aperture 134 and opening 56 in the actuator frame 46. This transverse path 135 allows for the insertion of the shank 136 of a padlock 137 through the actuator assembly 44. In a first position 139*a*, the shank 136 may pass through a transverse slot 140 in the slider 52, when the slider 52 is in the off position, to lock the slider 52 against motion that would allow movement of the collar 54 or the toggle operator 74 (shown in FIG. 4).

Alternatively, in a second position 139*b*, the aperture may be moved to position 134 so that the shank 136 of the padlock 137 may pass adjacent to an upper wall of the slider 52 to prevent movement of the slider 52 toward the "on" position, yet without requiring slot 140.

As shown in FIGS. 12 and 13, a body 142 of the padlock 137 may be positioned on either side of the frame 46 for flexible access to a key slot or combination operator of the padlock 137. The use of a padlock 137 directly on the actuator assembly 44 provides additional security against inadvertent activation of the switch 14, the latter as may be accessible through the cabinet door 20 when the handle 28 is in the "off" position.

Referring to FIG. 14, the collar 54 may provide an opening 144 through which the toggle operator 74 extends that narrows downward toward the electrical switch 14, like a funnel, to the substantially equal opening with two times the width of the toggle operator 74 at its entrance into the collar 54. In this way, the collar 54 not only serves to move the toggle operator 74 but, when locked, prevents movement of the toggle operator 74 while still accommodating the pivoting action of the toggle operator 74.

A lower portion of the collar 54 may be expanded in a flange 146 to provide a stabilizing surface that rests against the upper surface of the switch 14 for improved stability. Generally, in the locked position, the machine screws 66 (shown in FIG. 4) will still be accessible allowing removal of the actuator assembly 44 in the event of an inability to remove the padlock at a time when recommissioning of the switches is desired.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted, it is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

We claim:

1. A remote switching assembly for use with an electrical switch having a switch operator movable along an actuation axis, the remote switching assembly comprising:

an actuator frame presenting a longitudinal channel extending along a longitudinal axis and attachment elements for attaching the actuator frame to a housing of an electrical switch adjacent to the switch operator so that the longitudinal axis is substantially parallel to the actuation axis;

a slider fitting within the longitudinal channel of the actuator frame to slide therein along the longitudinal axis, the slider providing a collar receiving the switch operator when the actuator frame is fixed to the housing of the electrical switch, so that movement of the slider along the actuation axis may switch the switch operator between "on" and "off" states;

a flexible cable assembly providing a sheath surrounding a flexible cable, a first end of the sheath attached to the actuator frame and a first end of the flexible cable attached to the slider; and wherein the actuator frame includes at least one opening providing a path through the channel for receiving a lock shank to extend into the channel to block motion of the slider along the actuation axis to switch the switch operator from the "off" state to the "on" state.

2. The remote switching assembly of claim 1 wherein the at least one opening includes two opposed openings on opposite walls of the channel so that the lock shank may extend fully across the channel.

3. The remote switching assembly of claim 2 wherein one of the two opposed openings also provides passage of the collar of the slider out of the channel for motion of the slider along the actuation axis between the "off" state and the "on" state.

4. The remote switching assembly of claim 2 wherein the slider includes a third opening aligning with the two opposed openings through the channel when the slider is in the "off" state to receive the lock shank.

5. The remote switching assembly of claim 4 wherein the third opening is an upwardly opening slot extending perpendicularly to the actuation axis.

6. The remote switching assembly of claim 1 wherein the slider includes opposed upper and lower channels receiving corresponding upper and lower rails in the actuator frame so that the slider has sliding contact between the upper and lower channels and the corresponding upper and lower rails and between outer walls of the slider and walls of the channel and wherein a slot through the slider is positioned to allow the shank to pass below the upper rail.

7. The remote switching assembly of claim 1 wherein the attachment elements are flange portions of the actuator frame having holes for receiving machine screws to attach the actuator frame to the electrical switch.

8. The remote switching assembly of claim 2 further including a cover fitting over the channel of the actuator frame and wherein the two opposed openings are located to permit installation of the cover without interference from the lock shank.

9. The remote switching assembly of claim 8 wherein the cover attaches to the actuator frame by inter-engaging hook elements engaged by sliding of the cover and retained by a snap detent.

10. The remote switching assembly of claim 1 wherein the actuator frame and the slider are injection molded thermoplastic.

11. The remote switching assembly of claim 1 wherein the sheath and the flexible cable of the flexible cable assembly are connected to the actuator frame and the slider by means of keyway slots slidably engaging flange features on the sheath and flexible cable.

12. The remote switching assembly of claim 1 wherein the sheath and flexible cable are substantially resistant to extension in tension and contraction in compression.

13. The remote switching assembly of claim 1 further including a handle mechanism that is mountable to a cabinet surface having a handle frame and a handle movable with respect to the handle frame between a first position and a second position and wherein a second end of the sheath is attached the handle frame and a second end of the flexible cable is attached to the handle so that movement of the handle between the first position and second position move the slider in a range sufficient to switch the switch operator between the "on" and "off" states.

14. A remote switching assembly of claim 13 wherein the handle mechanism further includes an opening for receiving a lock shank for preventing movement of the handle from an off position in which the switch operator is in the "off" state to an on position.

15. An electrical switching station for controlling electrical power comprising:

a cabinet providing an interior volume accessible through a cabinet door when the cabinet doors open;

at least one electrical switch attached to the cabinet within the interior volume, the electrical switch having a switch operator extending from a front of a housing of the electrical switch and movable along an actuation axis to switch the electrical switch between an "on" and "off" state;

an actuator frame presenting a longitudinal channel extending along a longitudinal axis and attachment elements for attaching the actuator frame to the housing of an electrical switch adjacent to the switch operator so that the longitudinal axis is substantially parallel to the actuation axis;

a slider fitting within the longitudinal channel of the actuator frame to slide therein along the longitudinal axis, the slider providing a collar receiving the switch operator when the actuator frame is fixed to the housing of the electrical switch, so that movement of the slider along the actuation axis may switch the switch operator between "on" and "off" states;

a flexible cable assembly providing a sheath surrounding a flexible cable, a first end of the sheath attached to the actuator frame and a first end of the flexible cable attached to the slider; and wherein the actuator frame includes at least one opening providing a path through the channel for receiving a lock shank to extend into the channel to block motion of the slider along the actuation axis to switch the switch operator from the "off" state to the "on" state.

16. A method of disabling an electrical switch as may be disposed in a cabinet having a door, the electrical switch having a switch operator extending from a front of a housing of the electrical switch movable along an actuation axis to switch the electrical switch between an "on" and "off" state, using an apparatus including:

an actuator frame presenting a longitudinal channel extending along a longitudinal axis and attachment elements for attaching the actuator frame to a housing of an electrical switch adjacent to the switch operator so that the longitudinal axis is substantially parallel to the actuation axis;

a slider fitting within the longitudinal channel of the actuator frame to slide therein along the longitudinal axis, the slider providing a collar receiving the switch operator when the actuator frame is fixed to the housing of the electrical switch, so that movement of the slider along the actuation axis may switch the switch operator between "on" and "off" states;

a flexible cable assembly providing a sheath surrounding a flexible cable, a first end of the sheath attached to the actuator frame and a first end of the flexible cable attached to the slider; and wherein the actuator frame includes at least one opening providing a path through the channel for receiving a lock shank to extend into the channel to block motion of the slider along the actuation axis to switch the switch operator from the "off" state to the "on" state; the method comprising the steps of:

(a) placing the slider in a position moving the switch operator to the "off" state; and (b) inserting a lock shank through the opening and locking the same.

17. The method of claim 16 further including a handle mechanism that is mountable to a cabinet surface having a handle frame and a handle movable with respect to the handle frame between a first position and a second position and wherein a second end of the sheath is attached the handle frame and a second end of the flexible cable is attached to the handle so that movement of the handle between the first position and second position moves the slider in a range sufficient to switch the switch operator between the "on" and "off" states, wherein the handle mechanism further includes an opening for receiving a lock shank for preventing movement of the handle from an off position in which the switch operator is in the "off" state to an on position and further including the step of:

(c) inserting a second lock through the opening in the handle mechanism.

* * * * *